United States Patent [19]

Kane

[11] Patent Number: 4,999,863

[45] Date of Patent: Mar. 19, 1991

[54] PORTABLE COLLAPSIBLE BABY BED AND CARRYING BAG

[75] Inventor: Robert T. Kane, Discovery Bay, Hong Kong

[73] Assignee: Oprington Company Ltd., Tortola, British Virgin Isls.

[21] Appl. No.: 488,685

[22] Filed: Mar. 5, 1990

[51] Int. Cl.[5] ..... A47D 7/00; A47D 13/02

[52] U.S. Cl. ..... 5/98.1; 5/99.1; 5/420; 190/2

[58] Field of Search ..... 5/98 R, 99 R, 99 A, 5/417, 420; 190/2; 383/4; 294/140, 141; 224/151

[56] References Cited

U.S. PATENT DOCUMENTS

| | | | |
|---|---|---|---|
| 2,253,024 | 8/1941 | Farrand | 5/99 A X |
| 2,315,126 | 3/1943 | Michalke | 5/417 |
| 2,502,486 | 4/1950 | Savrin | 190/2 X |
| 2,626,407 | 1/1953 | Kurry | 5/99 R |
| 2,908,020 | 10/1959 | Barton | 190/2 X |
| 3,489,194 | 1/1970 | Hoover | 190/2 X |
| 4,723,300 | 2/1988 | Rosalind | 5/420 X |
| 4,886,150 | 12/1989 | Fitzsimmons | 5/420 X |

FOREIGN PATENT DOCUMENTS

| | | | |
|---|---|---|---|
| 133498 | 1/1948 | Australia | 190/2 |

*Primary Examiner*—Michael F. Trettel
*Attorney, Agent, or Firm*—Joseph S. Iandiorio

[57] ABSTRACT

A portable, collapsible baby bed and carrying bag includes a base panel foldable about a lateral axis; the base panel having a bottom surface and a top surface; engaging means for releasably securing together the base panel with the bottom surface facing itself on the opposite sides of the lateral axis in the folded position; peripheral wall extending up from and around the base panel and including opposing side walls and opposing end walls; two of the opposing walls including securing means for securing together the opposing walls over the base panel.

16 Claims, 6 Drawing Sheets

PORTABLE COLLAPSIBLE BABY BED AND CARRYING BAG

FIELD OF INVENTION

This invention relates to an improved portable, collapsible baby bed and shoulder bag.

BACKGROUND OF INVENTION

There are a number of problems associated with diapering infants while traveling There is the need for bags to carry clean and dirty diapers as well as other diaper changing equipment and lotions There is the need for a clean, comfortable place to put the baby to be changed. And there is the a need for third is the need to constrain the baby so it doesn't roll off the changing area.

SUMMARY OF INVENTION

It is therefore an object of this invention to provide an improved portable, collapsible carrying bag and changing pad with constraining means.

It is a further object of this invention to provide such a device which functions as a changing pad, a bed and a carrying bag.

It is a further object of this invention to provide such a device which is simple, lightweight, and easy to construct and collapse.

It is a further object of this invention to provide such a device which has sufficient constraints to permit its use even as a bed and has ample compartments for storing and carrying infant paraphernalia.

The invention results from the realization that a truly compact and effective portable, collapsible baby bed and carrying bag can be achieved by using a base panel that is foldable into a shoulder bag and that opens to yield constraining walls about an internal pad with storage compartments on the outside of the walls transverse to the fold axis and spaced on either side of the fold axis to freely permit the folding action.

SUMMARY OF INVENTION: II

This invention features a portable, collapsible baby bed and carrying bag including a base panel foldable about a lateral axis. The base panel has a bottom surface and a top surface. There are engaging means for releasably securing together the base panel with the bottom surface facing itself on either side of the lateral axis in the folded position. A peripheral wall extends up from and around the base panel and includes opposing side walls and opposing end walls. Two of the opposing walls include securing means for securing together the opposing walls over the base panel when the bed is collapsed preparatory to folding.

In a preferred embodiment the means for engaging the bottom surface of the base panel when it is folded on itself may include Velcro fastening means. The peripheral wall as well as the base panel may be made of fabric. The end walls and the side walls may be straight and parallel to each other. The side walls may be equal in length and the end walls may be equal in length. The lateral folding axis is generally parallel to the end walls and transverse to the side walls. There may be a base pad on the top surface and two end pads adjacent to the inner surface of the end walls. There are means for releasably fastening the end pads to the end walls. The base pad and the end pads may be integral. The means for releasably fastening the end pads to the end wall may include Velcro fastening means. The fastening means may actually be disposed between the end pads and the end walls. Securing means for securing together the walls when the bed is in the collapsed condition may include a zipper. The side walls may include storage compartments which are disposed on either side of the lateral axis. The bed may include handle means proximate each side wall, fastened to the base panel and generally centered over the lateral axis. There may also be a shoulder strap attached to the bottom surface of the base along the lateral axis.

The portable, collapsible baby bed and carrying bag of this invention may be accomplished with a base panel foldable about a lateral axis. The base panel may have a bottom surface and a top surface and may be made out of a suitable fabric such as nylon or the like. There is a peripheral wall extending up from and around the base panel and including opposing side walls and opposing end walls. That is, the shape of the bed is preferably rectangular with the opposing side walls being the longer walls and being equal and parallel to each other, and the end walls being the shorter walls and also being equal and parallel to each other. The bed is not restricted to a rectangular shape as it may be square, oval, or even round. In those cases the opposing side walls and end walls will not be parallel to each other but the bed will function in the same manner: after it is collapsed, the bed will be folded about the lateral folding axis so that the bottom surface meets itself and is attached by some engaging means for releasably securing the base panel to itself, such as hook and loop type fasteners sold under the trademark Velcro or other similar fasteners. The walls, of whatever shape, may be made of fabric which is integrally formed with the base panel such as by stitched seams. Two of the opposing walls, at least those which are generally transverse to the lateral axis, contain some means for securing them together when they are collapsed over the base panel.

The securing means may be a zipper or other suitable fastener. The bed may contain compartments, typically on the side walls, that is, the walls that are transverse to the lateral fold axis, and those compartments are spaced apart on either side of the lateral axis to permit the bed to be easily folded when it is in the collapsed position. Handles are provided proximate each of the side walls, fastened to the base panel and generally centered on the lateral axes. A shoulder strap may also be provided attached to the bottom surface of the base panel along the lateral axis.

DISCLOSURE OF PREFERRED EMBODIMENT

Other objects, features and advantages will occur to those skilled in the art from the following description of a preferred embodiment and the accompanying drawings, in which.

Figure 1:
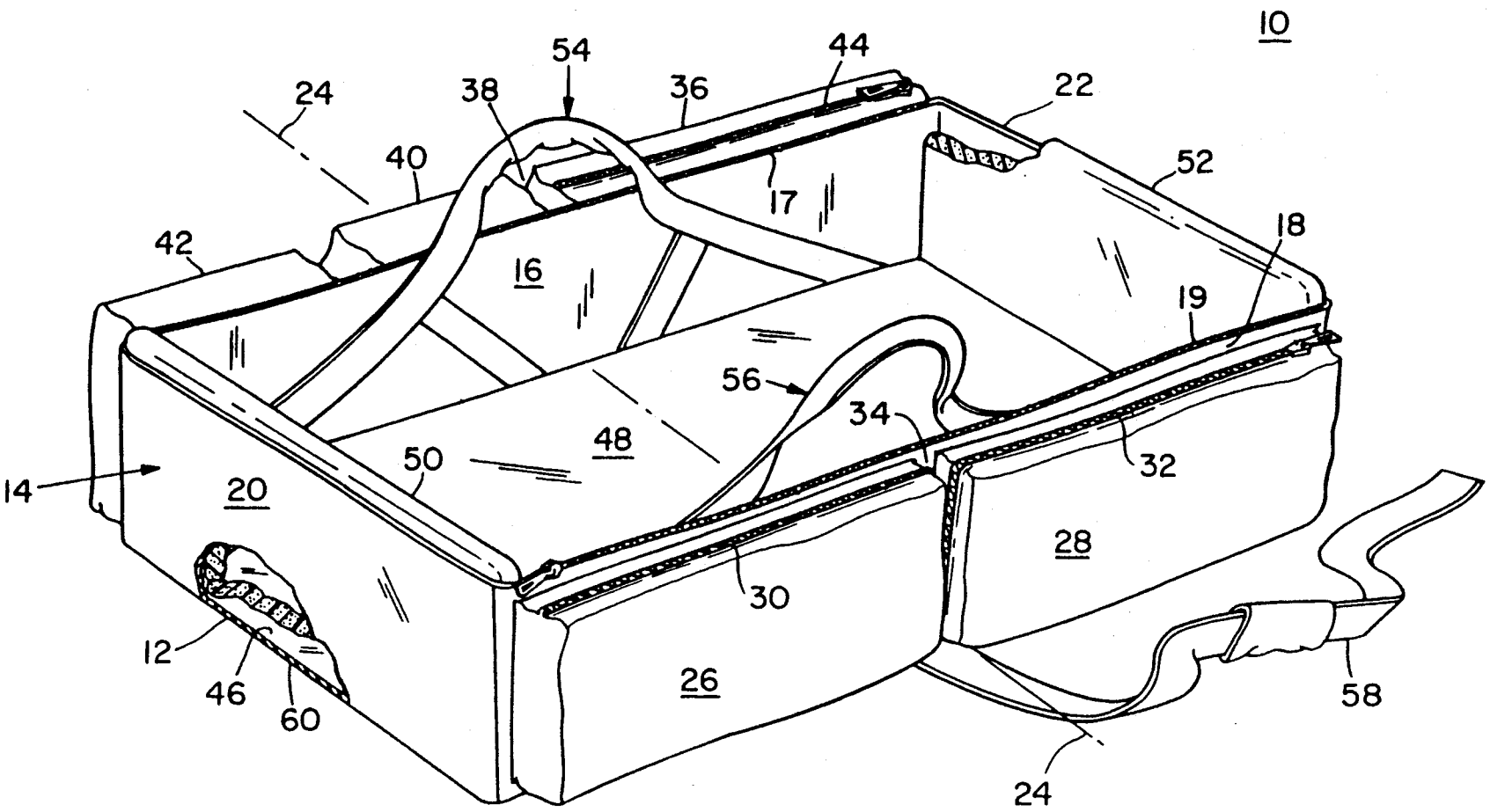
FIG. 1 is a perspective view with portions broken away of the portable, collapsible baby bed and carrying bag according to this invention opened into a bed.

There is shown in FIG. 1 a portable collapsible baby bed and carrying bag 10 according to this invention in the erected or constructed position. Bed and bag 10 includes a base panel 12 and a peripheral wall 14 having two opposing side walls 16 and 18 which are straight, equal in length, parallel to each other and form the longer side of the rectangular shape of bed and bag 10. Wall 14 also includes two end walls 20 and 22 which are also straight, equal and parallel to each other, and form the shorter sides of the rectangular shape. The side walls are formed of a conventional, durable and washable material such as nylon and are attached to each other such as by stitched seams at each corner and are similarly attached to base panel 12. Side walls 16 and 18 include some fastening means to secure them together when they are collapsed down over base pad 48, for example a zipper, one half of which, 17, is on the top of wall 16. The other half of the zipper, 19, is on the top of wall 18. Bed and bag 10, when collapsed as illustrated subsequently, is foldable about its lateral fold axis 24. Two compartments 26, 28 with zipper closures 30 and 32 are carried on side walls 18 spaced from each other by gap 34 aligned with fold axis 24. Similarly, side wall 16 contains compartment 36 separated by gap 38 at fold axis 24 from additional compartments 40 and 42. Compartment 36 also has a top zipper closure 44. Compartments 40 and 42 have zipper closures on their sides, more readily visible in FIG. 4.

Figure 2:
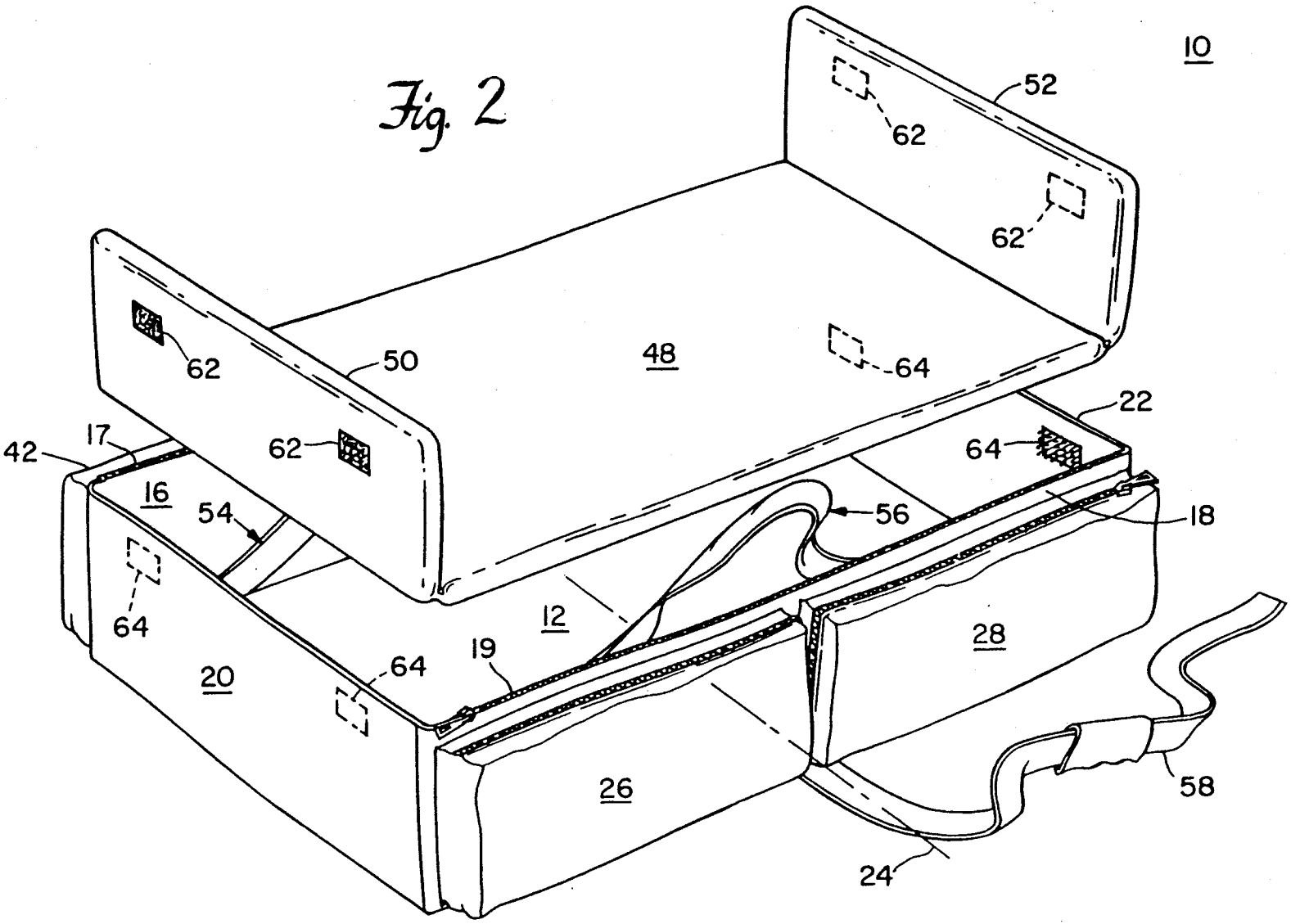
FIG. 2 is a view similar to FIG. 1 with the internal pad exploded out.

Disposed inside of wall 14 on the top surface 46 of base panel 12 are a base pad 48 and two end pads 50 and 52. Handles 54 and 56 are provided generally centered over fold axis 24 and fastened to bed and bag 10 by stitching at the seams between side walls 16, 18 and base panel 12, respectively. A shoulder strap 58 may be provided fastened to the bottom surface 60 of base panel 12 along the fold axis 24. Base pad 48, FIG. 2, and end pads 50 and 52 may be formed integrally and may be made of a suitable non-allergenic washable packing covered by a moisture-resistant and washable fabric. Pads 48, 50 and 52 may be secured in bed and bag 10 by means of Velcro fastener elements 62 mounted on each end pad 50 and 52, and mating Velcro fastener elements 64 on end walls 20 and 22.

Figure 3:
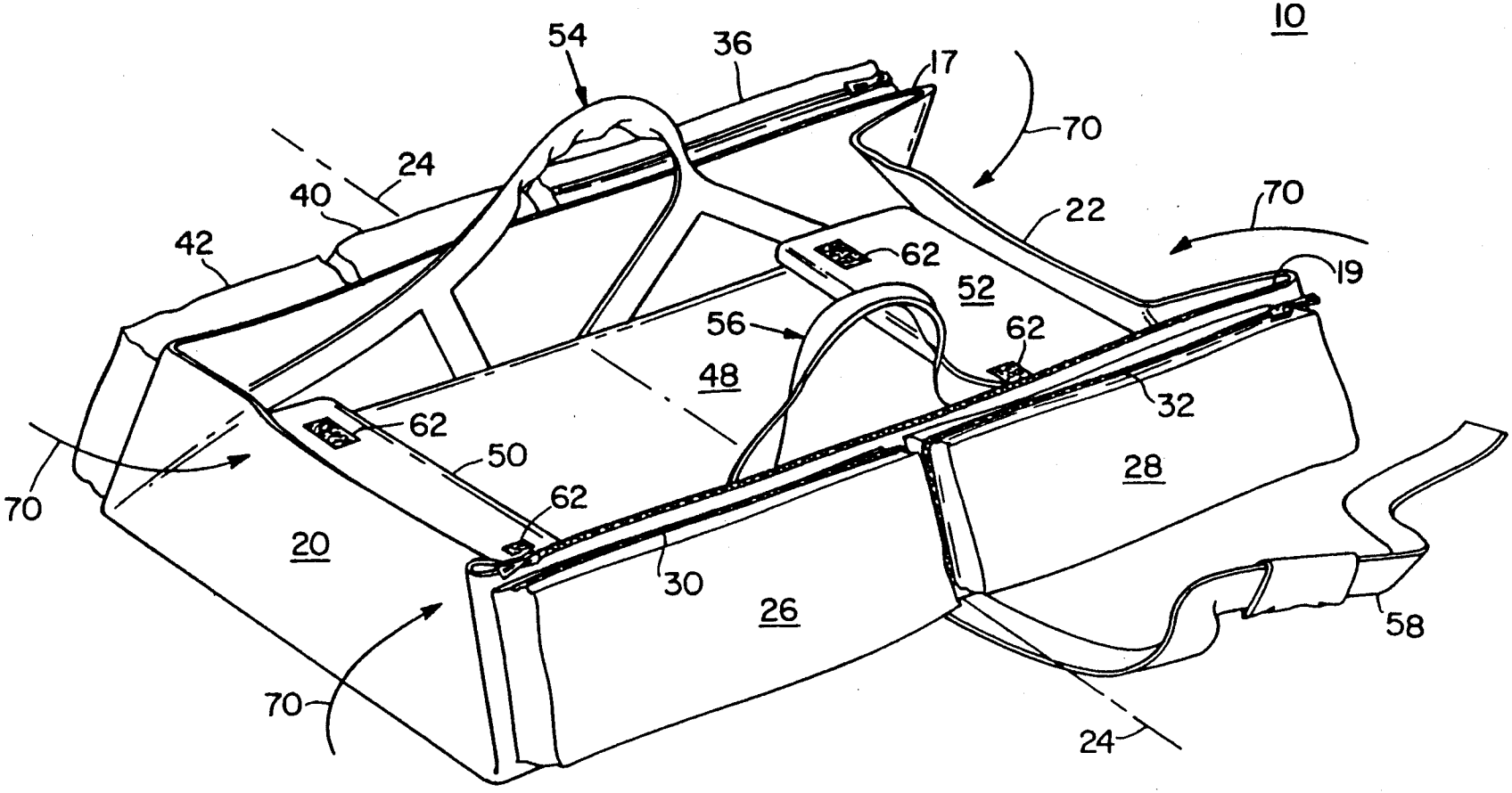
FIG. 3 is a view similar to FIG. 1 with the end pads collapsed and the end walls starting to collapse.

Bed and bag 10 is converted to a carrying bag in two stages. In the first stage, the bed is collapsed flat. Then, in the second stage it is folded about the lateral fold axis 24. The process begins with the detachment of end pads 50, 52 from end walls 20, 22 as shown in FIG. 3, where end pads 50 and 52 have had their Velcro attachments released from end walls 20 and 22 and end pads 50, 52 have been laid down against base pad 48. Following this, end walls 20 and 22 are collapsed on top of end pads 50 and 52 by a force applied in the direction of arrows 70.

Figure 4:
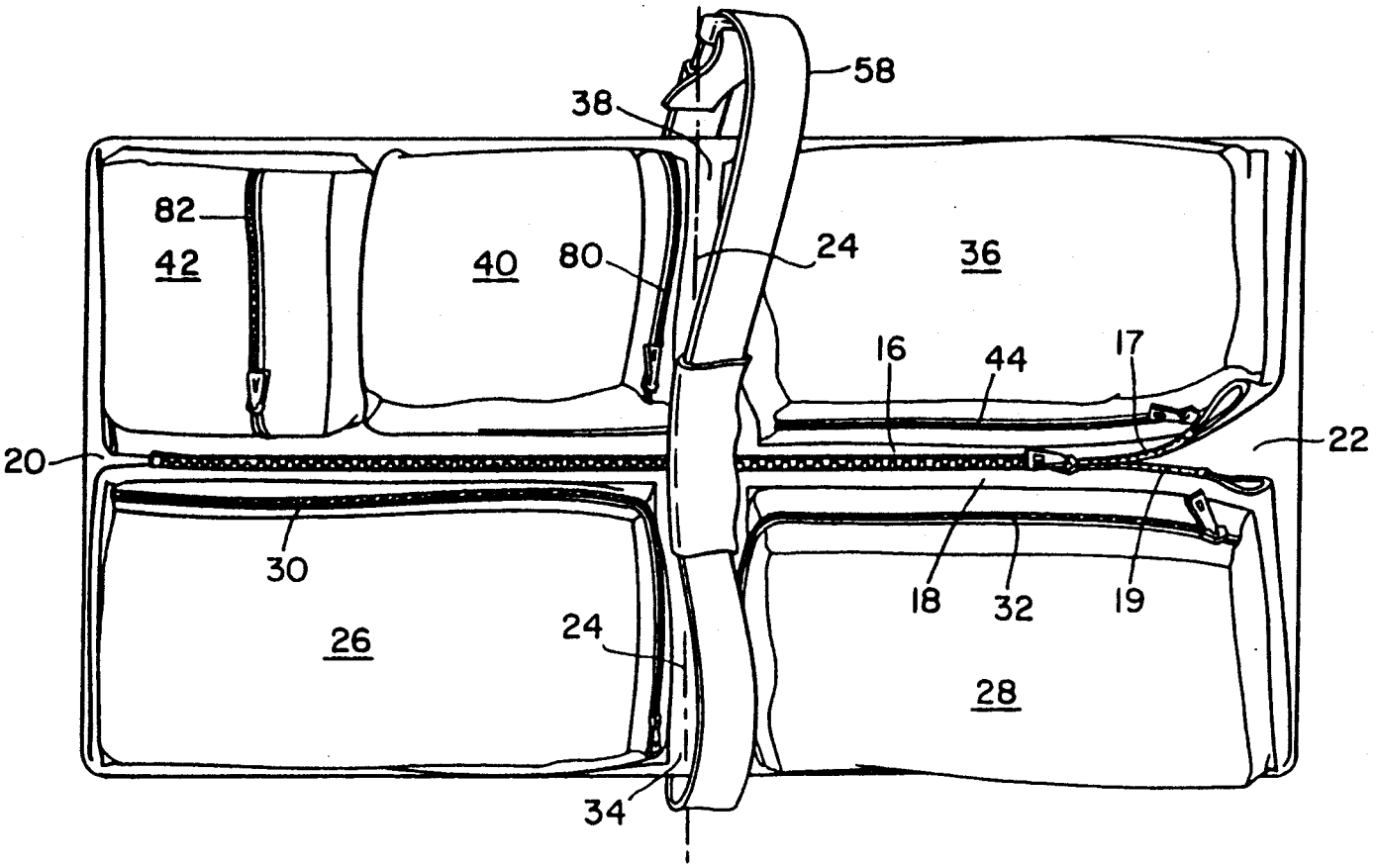
FIG. 4 is a top plan view of the portable collapsible baby bed and carrying bag of FIG. 1 in the first collapsed stage with the walls and pads down and the side wall tops secured together by a zipper.
Figure 5:
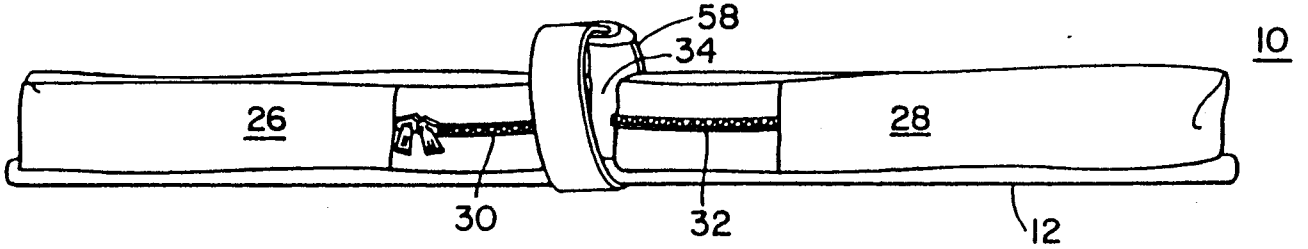
FIG. 5 is a side elevational view of the collapsible baby bed of FIG. 4.
Figure 6:
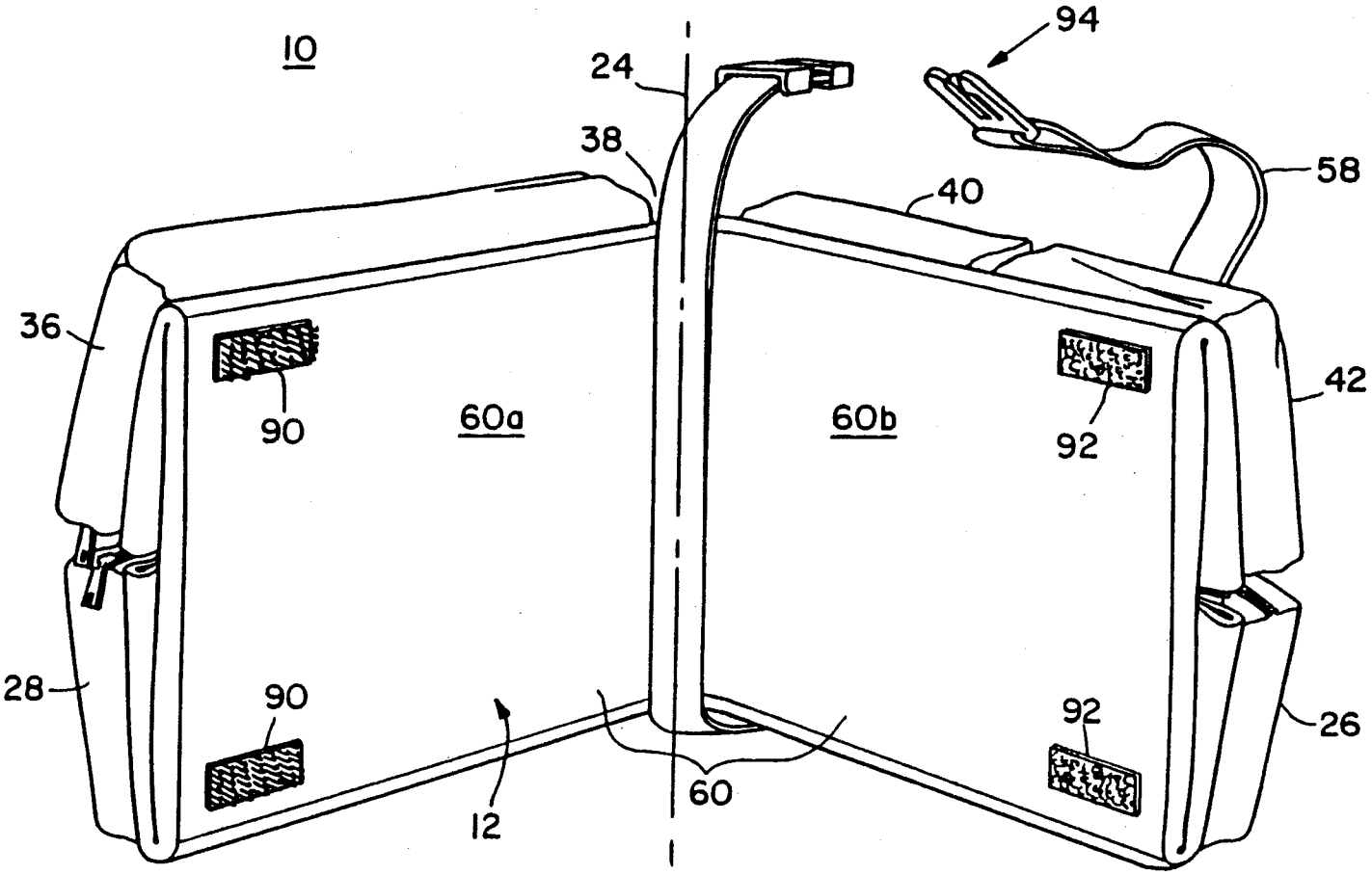
FIG. 6 is a perspective bottom view of the portable collapsible baby bed of FIGS. 4 and 5 partway to the second and final collapsed stage with the base panel folding about the lateral axis.
Figure 8:
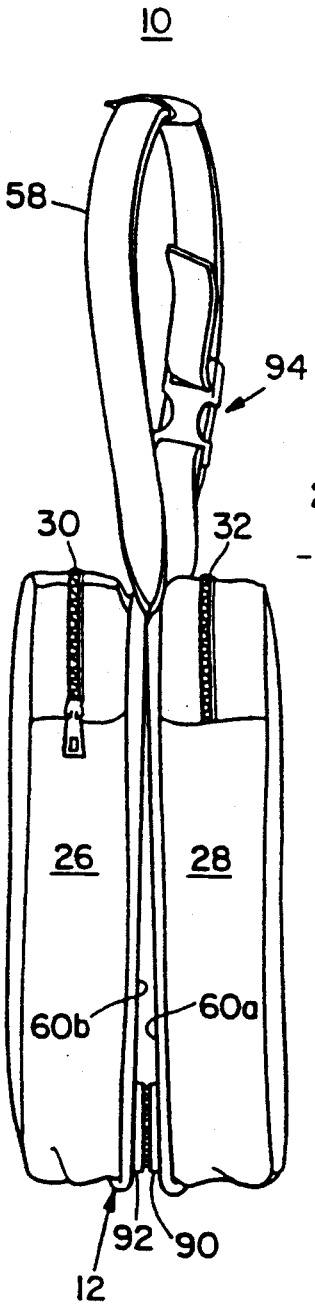
FIG. 8 is a side elevational view of the portable collapsible baby bed of FIG. 7.
Figure 7:
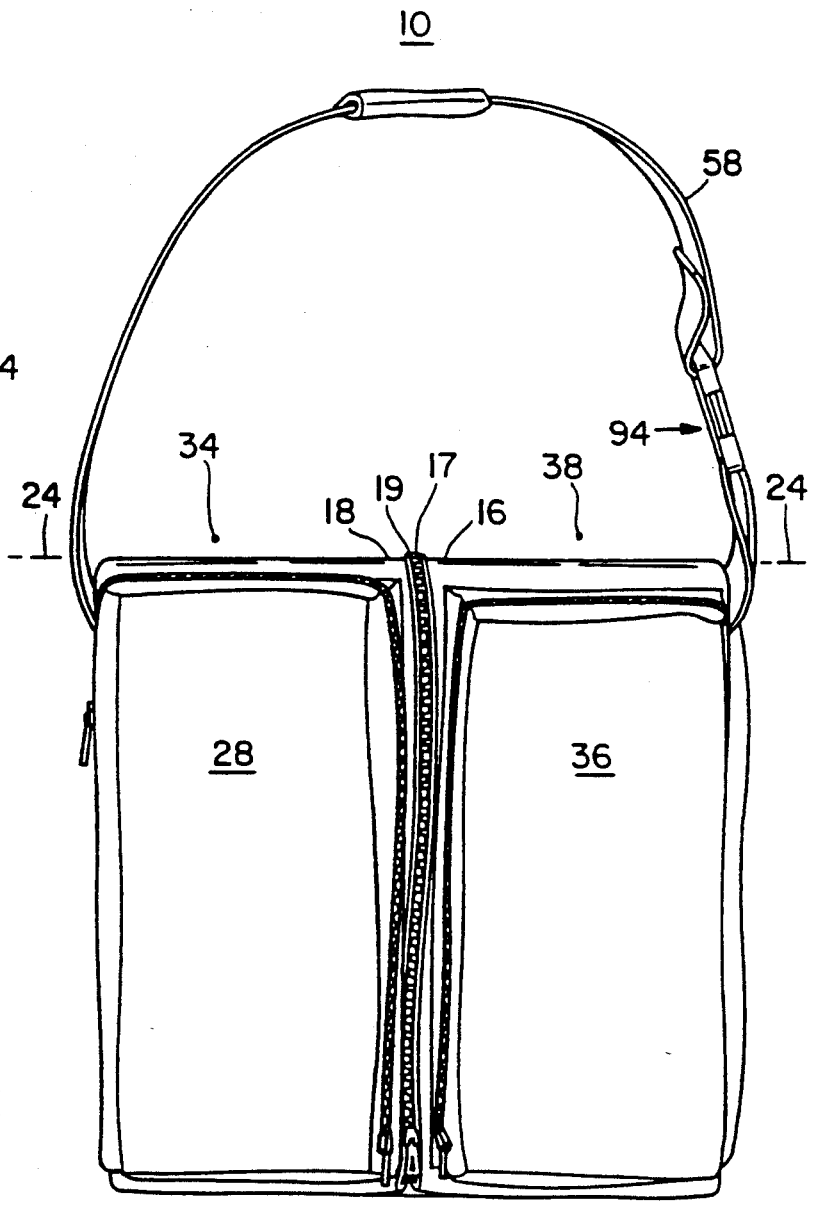
FIG. 7 is a front elevational view of the portable collapsible baby bed of FIGS. 4, 5 and 6 in the final collapsed stage.

After walls 20 and 22 are collapsed, handles 54 and 56 are tucked under and then side walls 16 and 18 are collapsed down on top of the end walls and base pad 48. At this point, zipper halves 17 and 19 are closely adjacent one another and can be zipped together as shown in FIG. 4. Zipper closures 80, 82 of compartments 40 and 42 are plainly visible in FIG. 4. In the second or intermediate stage, the collapsed bed has a flat planar look, as can be more readily seen from FIG. 5. To achieve the final stage, bed and bag 10 is folded about its lateral axis 24, FIG. 6, so that the bottom surface 60 of base panel 12 is brought face to face with itself. That is, portion 60*a* and portion 60*b* of bottom surface 60 are brought together face to face so that the fasteners such as Velcro pads 90 on portion 60*a* and pads 92 on portion 60*b*, come in contact and secure the two halves together about the fold axis 24. Shoulder strap 68 includes a conventional spring clasp 94 which is clipped together to close strap 58 that becomes the carrying handle or shoulder strap for the completed bag as shown in FIGS. 7 and 8.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A portable, collapsible baby bed and carrying bag comprising:

a base panel foldable about a lateral axis; said base panel having a bottom surface and a top surface;

engaging means for releasably securing together said base panel with its bottom surface facing itself on opposite sides of the lateral axis in the folded position;

a peripheral wall extending up from and around said base panel and including opposing side walls and opposing end walls;

two of said opposing walls including securing means for securing together said opposing walls over said base panel.

2. The portable, collapsible baby bed and carrying bag of claim 1 in which said engaging means includes hook and loop type fastening means.

3. The portable, collapsible baby bed and carrying bag of claim 1 in which said peripheral wall is made of fabric.

4. The portable, collapsible baby bed and carrying bag of claim 1 in which said end walls and said side walls are straight and parallel to each other.

5. The portable, collapsible baby bed and carrying bag of claim 1 in which said end walls and said side walls are unequal in length.

6. The portable, collapsible baby bed and carrying bag of claim 1 in which said lateral axis extends generally parallel to said end walls and transverse to said side walls.

7. The portable, collapsible baby bed and carrying bag of claim 1 further including a base pad on said top surface and two end pads adjacent to the inner surface of said end walls.

8. The portable collapsible baby bed and carrying bag of claim 7 in which said base pad and said end pads are integral.

9. The portable collapsible baby bed and carrying bag of claim 7 further including means for releasably fastening said end pads to said end walls.

10. The portable collapsible baby bed and carrying bag of claim 9 in which said means for releasably fastening includes hook and loop type fasteners.

11. The portable collapsible baby bed and carrying bag of claim 10 in which said means for releasably fastening are disposed between said end pads and said end walls.

12. The portable collapsible baby bed and carrying bag of claim 1 in which said base panel is fabric.

13. The portable collapsible baby bed and carrying bag of claim 1 in which said securing means is a zipper.

14. The portable collapsible baby bed and carrying bag of claim 1 in which said side walls include storage compartments spaced on either side of said lateral axis.

15. The portable collapsible baby bed and carrying bag of claim 1 further including handle means proximate each side wall, fastened to said base panel and generally centered over said lateral axis.

16. The portable collapsible baby bed and carrying bag of claim 1 further including shoulder strap means attached to the bottom surface of said base panel along said lateral axis.

* * * * *